US011612922B2

(12) United States Patent
Sprock et al.

(10) Patent No.: US 11,612,922 B2
(45) Date of Patent: Mar. 28, 2023

(54) COOLING DEVICE AND METHOD FOR OPERATING SAME

(71) Applicant: SMS group GMBH, Düsseldorf (DE)

(72) Inventors: August Sprock, Düsseldorf (DE); Christoph Hassel, Duisburg (DE); Ulrich Cramer, Attendorn (DE)

(73) Assignee: SMS GROUP GMBH, Dusseldorf (DE)

( * ) Notice: Subject to any disclaimer, the term of this patent is extended or adjusted under 35 U.S.C. 154(b) by 171 days.

(21) Appl. No.: 17/047,192

(22) PCT Filed: Apr. 4, 2019

(86) PCT No.: PCT/EP2019/058452
§ 371 (c)(1),
(2) Date: Oct. 13, 2020

(87) PCT Pub. No.: WO2019/197255
PCT Pub. Date: Oct. 17, 2019

(65) Prior Publication Data

US 2021/0162478 A1 Jun. 3, 2021

(30) Foreign Application Priority Data

Apr. 13, 2018 (DE) ..... 10 2018 205 685.4

(51) Int. Cl.
*B21B 45/02* (2006.01)
*C21D 1/62* (2006.01)
(Continued)

(52) U.S. Cl.
CPC ..... *B21B 45/0218* (2013.01); *B21B 45/0233* (2013.01); *C21D 1/62* (2013.01);
(Continued)

(58) Field of Classification Search
CPC . B21B 37/74; B21B 45/0218; B21B 45/0233; C21D 11/005; C21D 1/62;
(Continued)

(56) References Cited

U.S. PATENT DOCUMENTS 4,591,133 A * 5/1986 Umeno ..... B21B 45/0233 72/201
4,785,646 A * 11/1988 Uekaji ..... B21B 37/44 72/8.5
(Continued)

FOREIGN PATENT DOCUMENTS

CN 104741389 A 7/2015
CN 105170662 A 12/2015
(Continued)

OTHER PUBLICATIONS

International Search Report dated Aug. 5, 2019 in corresponding International application No. PCT/EP2019/058452; 15 pgs.
(Continued)

*Primary Examiner* — Scott R Kastler
*Assistant Examiner* — Michael Aboagye
(74) *Attorney, Agent, or Firm* — Maier & Maier, PLLC

(57) ABSTRACT

A cooling device for cooling a metallic item and a method for operating the cooling device. Such cooling devices having a plurality of cooling bars arranged in parallel in groups for applying a coolant to the metallic item are known in the prior art. In order to be able to set a desired distribution function of the coolant over the width of the metallic item as precisely as possible, the cooling device provides that similar application regions in at least two cooling bars within a group are each formed differently with respect to their contour and/or with respect to their surface area.

11 Claims, 3 Drawing Sheets

(51) Int. Cl.

| | |
|---|---|
| ***C21D 1/667*** | (2006.01) |
| ***C21D 8/02*** | (2006.01) |
| ***C21D 9/46*** | (2006.01) |
| ***C21D 11/00*** | (2006.01) |
| *B21B 37/74* | (2006.01) |

(52) U.S. Cl.
CPC ..... *C21D 1/667* (2013.01); *C21D 8/0247* (2013.01); *C21D 9/46* (2013.01); *C21D 11/005* (2013.01); *B21B 37/74* (2013.01); *B21B 2261/20* (2013.01); *C21D 2221/00* (2013.01)

(58) Field of Classification Search
CPC .. C21D 1/667; C21D 2221/00; C21D 8/0247; C21D 9/46
USPC ..... 266/259, 249, 46
See application file for complete search history.

(56) References Cited

U.S. PATENT DOCUMENTS

| | | | | |
|---|---|---|---|---|
| 8,404,062 | B2 * | 3/2013 | Ueoka | C21D 9/46 148/657 |
| 8,881,568 | B2 * | 11/2014 | Nakata | B21B 45/0233 72/201 |
| 9,868,142 | B2 * | 1/2018 | Chen | B21B 43/00 |
| 2011/0030432 | A1 | 2/2011 | Malik et al. | |
| 2016/0052033 | A1 | 2/2016 | Chen et al. | |

FOREIGN PATENT DOCUMENTS

| | | | | | |
|---|---|---|---|---|---|
| CN | 105188975 | A | | 12/2015 | |
| DE | 19854675 | A1 | | 6/2000 | |
| EP | 0081132 | A1 | | 6/1983 | |
| EP | 2986400 | A1 | | 2/2016 | |
| JP | S51147449 | A | | 12/1976 | |
| JP | 58-090313 | A | | 5/1983 | |
| JP | 2008194712 | A | | 8/2008 | |
| JP | 2011167754 | | * | 9/2011 | B21B 45/0218 |
| JP | 2011167754 | A | | 9/2011 | |
| JP | 2012-520769 | A | | 9/2012 | |
| JP | 2012520770 | A | | 9/2012 | |
| JP | 2015160240 | A | | 9/2015 | |
| JP | 2016-515474 | A | | 5/2016 | |
| JP | 2016187822 | A | | 11/2016 | |
| JP | 2016215263 | A | | 12/2016 | |
| WO | 2005099923 | A1 | | 10/2005 | |
| WO | 2015113832 | A1 | | 8/2015 | |

OTHER PUBLICATIONS

Japanese Office Action dated Oct. 21, 2021, in connection with corresponding JP application No. 2020-554491 (8 pp., including machine-generated English translation).
Office Action dated Nov. 22, 2021, in connection with corresponding Chinese Application No. 201980025437.1 (26 pp., including machine-generated English translation).

* cited by examiner

COOLING DEVICE AND METHOD FOR OPERATING SAME

FIELD

The invention relates to a cooling device for cooling a metallic item, in particular a metal strip, and a method for its operation.

BACKGROUND

Such cooling devices having a plurality of cooling bars arranged in parallel for applying a coolant to a metallic item are well known in the prior art; thus, for example, from European patent specification EP 0 081 132 and German patent application DE 198 54 675 A1.

Said European patent specification thus discloses a cooling device having a plurality of cooling bars which extend in the transport direction or the longitudinal direction of the metallic item to be cooled. At the same time, however, a plurality of these cooling bars are arranged in the width direction of the metallic item. A volume flow of a coolant can be applied to each cooling bar individually. In this way, different distributions of the volume flow of coolant can be implemented over the width of the metallic item to be cooled.

Published application DE 198 54 675 A1 discloses a cooling device having a plurality of cooling bars, which each extend transversely to the longitudinal direction of the metallic item to be cooled and are arranged in parallel. Each cooling bar carries, distributed over its length, i.e., distributed over the width of the metallic item, a plurality of application tubes or nozzles, which can each in turn be individually activated with respect to the coolant volume flow to be applied. In this way, a very individual distribution of the coolant volume flow over the metallic item to be cooled may also be implemented.

Finally, European patent specification EP 2 986 400 B1 discloses a cooling device. Specifically, the cooling device disclosed therein has at least one cooling bar for applying a coolant to a metallic item, wherein each cooling bar has at least one left, one middle, and one right application region in its longitudinal direction. The application regions are adjacent in pairs in the longitudinal direction of the cooling bar and the area and/or contour thereof are formed differently. Specifically, all three regions are triangular in the patent specification. Separate pumps and valves are associated with each application region for controlling or adjusting the coolant volume flow in the individual application regions.

The known cooling devices do enable a limited adjustment of the distribution of the coolant volume flow over the width of the rolled stock; however, the adjustment options for the distributions are limited. It is thus not always possible using these limited adjustment options to react adequately to strips or plates having different widths and to apply a certain coolant quantity distribution over the strip width in accordance with the strip width. With the same coolant quantity distribution in the cooling bars within a group of cooling bars, very narrow metallic items are hardly masked, while the masking of wider metallic items is much too deep. Furthermore, the similarity of application regions in the cooling bars of a group in combination with an arrangement in a row of outlet openings for the coolant in the cooling bar necessarily results in stepped coolant application over the width of the rolled item. This creates the risk of strip-shaped cooling of the metallic item.

The invention is based on the object of refining a known cooling device, a known method for its operation, and a known rolling arrangement having such a cooling device in such a way that the options for setting certain distributions of the coolant over the width of the metallic item are improved.

SUMMARY

Accordingly, the cooling device according to the invention is characterized in that the first application region of the first cooling bar is designed differently in its contour and/or area than the first application region of the adjacent second cooling bar in the same group.

Due to the claimed different design of the same application regions in adjacent cooling bars within a group, preferably in combination with the additionally claimed individual option for adjusting the pressure or the volume flow of the coolant in each application region, a nearly arbitrary distribution of the coolant can be implemented over the width of the rolled item. By assigning multiple parallel cooling bars having individual application regions and preferably additionally individual coolant application per application region to a group, in particular technically preferred parabolic distributions of the coolant may be implemented over the width of the metallic item. Individual pressure or volume flow in each application region does not exclude equal pressure or volume flow in various application regions.

The term "area" means surface area.

In the present description, the term "group" means a plurality of cooling bars arranged in parallel, wherein the number of the cooling bars per group is determined by the ultimately desired or predetermined distribution of the coolant over the rolled material. The more members or cooling bars are assigned to a group, the more finely or precisely can a desired coolant distribution be implemented.

The term "adjacent in pairs" means that of the at least three provided application regions per cooling bar, not all three application regions are simultaneously adjacent to one another. The application regions are typically arranged in succession in the longitudinal direction in each of the cooling bars, so that typically only two at a time, i.e., one pair of application regions are always adjacent.

The terms "left, middle, and right" relate to the representation of the application regions in the figures. In a real arbitrary arrangement of the cooling bars in space, these designations are to be changed suitably.

The terms "first" and "second" cooling bar are used solely to physically differentiate the cooling bars; they do not denote the sequence or ranking of the cooling bars within the group.

The first application region of the first cooling bar and the first application region of the second cooling bar are arranged and designed in such a way that they both spray essentially an equal or common first width section of the item using coolant in spite of their differences. In these terms, the first application region of the first cooling bar and the first application region of the second cooling bar are identical or similar in terms of the present description.

This statement also applies similarly to all other application regions and all further width sections. The first and further width sections are to be distinguished from one another.

The term "equal application regions" excludes mixed combinations of application regions which each spray different width regions of the item in different cooling bars, for example, first and third, or second and third application region in different cooling bars.

The boundary between two adjacent application regions of a cooling bar is marked by a boundary line in each case. The boundary line does not have to extend linearly, but rather can also extend curved or stepped between individual application tubes or nozzles of the respective cooling bar. If it is mentioned in the following description that the boundary line is inclined at an angle $\alpha$ with respect to the longitudinal axis of the respective cooling bar, then a real or virtual straight boundary line is assumed. If the boundary line is actually not straight, but rather stepped or wavy, a virtual straight boundary line through the actually non-straight boundary line is assumed for the definition of the angle $\alpha$. The virtual straight boundary line is then used as a representation or center line through the actually non-straight boundary line.

According to a first exemplary embodiment of the cooling device according to the invention, the different configuration between the same application regions in two adjacent cooling bars of the same group can be achieved in that the boundary lines in the two cooling bars to be compared are either inclined at different angles angles $\alpha$ in relation to the longitudinal axis of the respective cooling bar and/or the boundary lines are positioned differently along the longitudinal axis of the cooling bars in the x direction, i.e., are displaced in relation to one another in the x direction. Both alternatives actually effectuate an expansion of the possibility for setting a desired distribution of the coolant over the width of the metallic item.

The above-mentioned object of the invention is furthermore achieved by a rolling mill having at least one rolling stand for rolling the metallic item and having a cooling device according to the present invention, which is typically connected downstream of the rolling stand. A first group of cooling bars according to the invention can be arranged to apply the coolant to the upper side of the metallic item and at least one second group of cooling bars can be provided to apply the coolant to the lower side of the metallic item.

Finally, the above-mentioned object of the invention is also achieved by a method for operating the cooling device according to the invention. According to this method, the pressure or the volume flow of the coolant in the individual application regions of at least one cooling bar within the group is adjusted in each case as a function of at least one of the following parameters of the rolled item: width of the metallic item, temperature distribution of the rolled item to be cooled over its width, and/or chemical composition. Said parameters can be measured or calculated at the input or at the output of the cooling device, depending on this one refers to a pilot control or a regulation.

The advantages of the claimed rolling mill and the claimed method correspond to the advantages mentioned above with reference to the claimed cooling device.

Finally, it is also possible to individually change the distribution of the pressure or the volume flow of the coolant over the length of the individual cooling bars during the passage of the metallic items through the cooling device as a function of the parameters.

Further advantageous designs of the devices according to the invention and the method according to the invention are the subject matter of the disclosure.

BRIEF DESCRIPTION OF THE DRAWINGS

Five figures are appended to the description, wherein.

DETAILED DESCRIPTION

Figure 1:
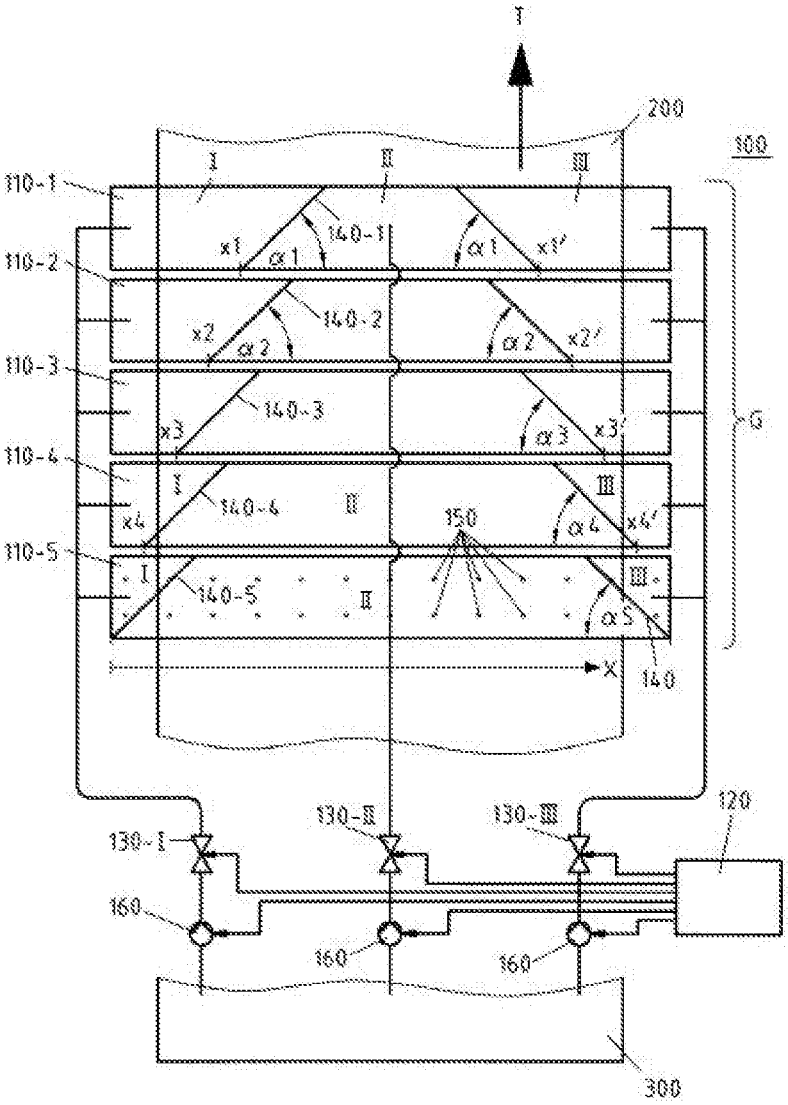
FIG. 1 shows a cooling device according to the invention having a group of five cooling bars by way of example, wherein the application regions of the cooling bars are designed in the form of a first pattern or a first exemplary embodiment.

The invention is described in detail hereinafter with reference to the mentioned figures in the form of exemplary embodiments. In all exemplary embodiments, the same technical elements are designated by the same reference numerals.

FIG. 1 shows a cooling device 100 for cooling a metallic item 200, in particular a metal strip. The cooling device consists of a plurality of cooling bars 110-*n* arranged in parallel with n=1 . . . N, here N=5 by way of example, for applying a coolant 300 to the metallic item 200. The coolant is pumped from a tank into the cooling bars 110 with the aid of pumps 160 and valves 130. Each cooling bar 110-*n* is divided in its longitudinal direction into at least one left, one middle, and one right application region I, II, III having respective application tubes or nozzles 150. In this case, each two application regions are adjacent, which is why the description also refers to adjacent in pairs. Each application region I, II, III of a cooling bar is assigned a separate valve 130, so that a pressure or volume flow of the coolant can be applied individually to the individual regions. In FIG. 1, all left application regions I are connected, for example, to the same valve 130-I and are thus connected in parallel. Likewise, all middle application regions II of the cooling bars 110-*n* with N=1-5 are connected to the same valve 130-II and are thus also connected in parallel. Similarly, all right application areas III are connected to a third valve 130-III.

In a more detailed variant, the respective similar application regions I, II, III are not each connected in parallel with respect to the coolant supply, but rather alternatively a separate valve can also be assigned to each application region of each cooling bar. In the exemplary embodiment shown in FIG. 1, where the group G has five cooling bars 110-1 . . . -5 having three application regions each, then, for example, 3*5=15 control valves would be provided for this group. In principle, all subsets are also conceivable, wherein then the individual similar application regions are each only partially connected in parallel.

In this way, in particular, the pressures or the volume flows of the coolant in the individual application regions I, II, III can be set individually at least in groups, here for the one group G shown.

All valves 130 and all pumps 160 are connected to a control unit 120 and are activated individually by this control unit.

In the first exemplary embodiment shown in FIG. 1, the application regions I, II, III of the cooling bars 110-1 . . . -5 each differ in the size of their area, i.e., with respect to their surface area. Specifically, it can be seen that the border lines 140-*n* with n=1 . . . –5 are each positioned differently in the individual cooling bars in the longitudinal direction of the cooling bars. The slopes of all border lines 140 are all equal in the exemplary embodiment shown in FIG. 1, therefore the angles α1 and α2 are also equal everywhere, however, the starting points xn, xn' with x=1 . . . 5, are each different, here as an example in all cooling bars 110-1 . . . -5 of the group G. Specifically, the area of the trapezoidal middle application region II thus becomes larger and larger from the cooling bar 110-1 to the cooling bar 110-5, while at the same time the areas of the left and right application regions I, III successively become smaller and smaller. This is because the total spray area of each individual cooling bar always remains equal even upon a displacement of the boundary lines 140.

It can furthermore be seen that in the cooling bars 110-1 . . . -4, all application regions are always trapezoidal, while in the fifth cooling bar 110-5, the two outer application regions I and III are each triangular and only the middle cooling region II is trapezoidal.

Each of the cooling bars has at least one, but typically a plurality of application tubes or nozzles 150 in each application region, wherein these application tubes or nozzles can also solely be formed in the form of simple openings in the cooling bar.

The cooling bars 110-*n* extend with their longitudinal axis transversely to the transport direction T of the rolled item 200.

In contrast to what is shown in FIG. 1, the individual cooling bars 110 of a group G can in principle also at least partially have a different number of application regions.

A group G of cooling bars 110-*n* is defined via a desired distribution of the coolant 300 over the width of the metallic item 200. The desired distribution function results from superimposing the individual distribution functions of the individual cooling bars within the group G. The more cooling bars having differently formed application regions I, II, III are combined in a group, the more precisely a desired overall distribution function for the coolant can be implemented. In particular, a technically preferred fine parabolic application of coolant 300 to the metallic item 200 may then be implemented.

Figure 2:
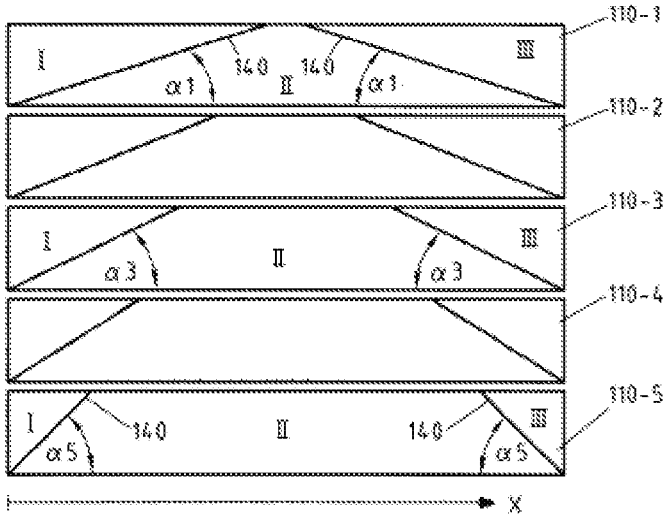
FIG. 2 shows a second pattern or exemplary embodiment of the arrangement of the application regions within the group.

FIG. 2 shows a second exemplary embodiment of the design of the application regions, which each differ in their surface area and in their contour from cooling bar to cooling bar. In the second exemplary embodiment, the two outer, i.e., the left and the right application region I, III are each triangular and the middle region is trapezoidal. The different design in area and contour is implemented in the second exemplary embodiment in that the boundary lines 140 are each inclined differently in relation to the longitudinal direction of the cooling bars from cooling bar to cooling bar The angles of inclination α1 . . . –α5 become larger and larger from the first cooling bar 110-1 to the last cooling bar 110-5 of the group G. The trapezoidal middle application regions are thus always enlarged, while the respective outer application regions I and III are proportionally reduced in size. In the second exemplary embodiment shown in FIG. 2, the boundary lines 140 each begin in the lower left corner and in the lower right corner. This means that the different application regions in the second exemplary embodiment are only due to a change of the angle α of the boundary lines in relation to the longitudinal axis of the cooling bars, but without the boundary lines 140 being positioned differently along the x-axis.

Figure 3:
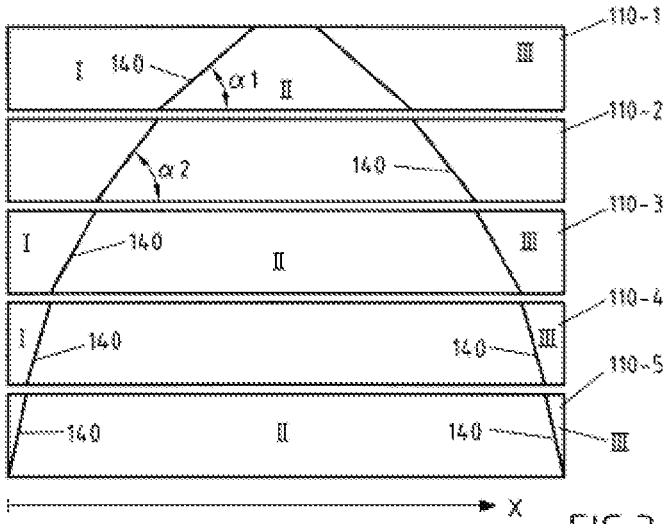
FIG. 3 shows a third pattern or exemplary embodiment of the arrangement of the application regions within the group.

FIG. 3 shows a third exemplary embodiment of the configuration of the application regions I, II, and III in a group G of five cooling bars. In the third example, the difference of the individual application regions from cooling bar to cooling bar is implemented in that both the angles of inclination α1 . . . –α5 in relation to the longitudinal axis of the cooling bars and also the positions x1 . . . –x5 of the boundary lines along the x-axis or the longitudinal axis of the cooling bars can be varied from cooling bar 110-1 to cooling bar 110-5.

Figure 4:
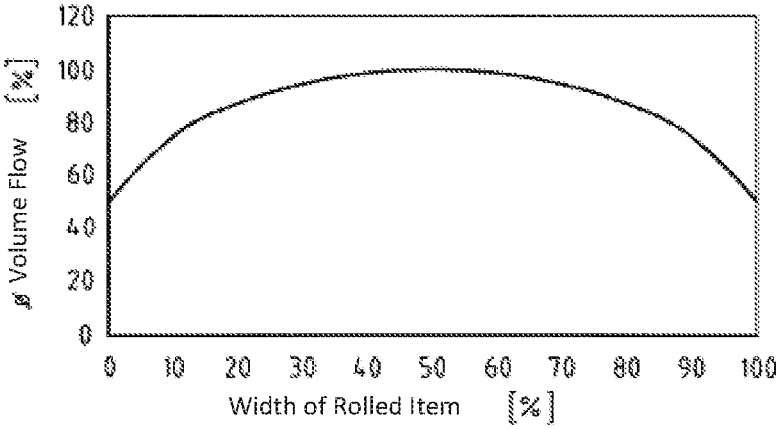
FIG. 4 shows an example of the distribution of the volume flow of the coolant over the width of the metallic item according to the present invention.

FIG. 4 shows by way of example a distribution function of the average volume flow of the coolant 300 over the width of the metallic item 200. The distribution function shown is an example of how, using the combination of a plurality of cooling bars 110-1 . . . -5 each having different application regions I, II, III within a group G, as shown in FIGS. 1 to 3, in particular a steady parabolic distribution can be implemented over the width of the metallic item. The emphasis here is on the word "steady". This means that the transitions between individual linear sections of the distribution function do not have jumps, but instead run relatively smoothly. The transitions can be made smoother the more cooling bars are in the group and the more the application regions within a group overlap. Notwithstanding the symmetrical distribution shown in FIG. 4, an asymmetrical setting of the left and right sides is also possible.

Figure 5:
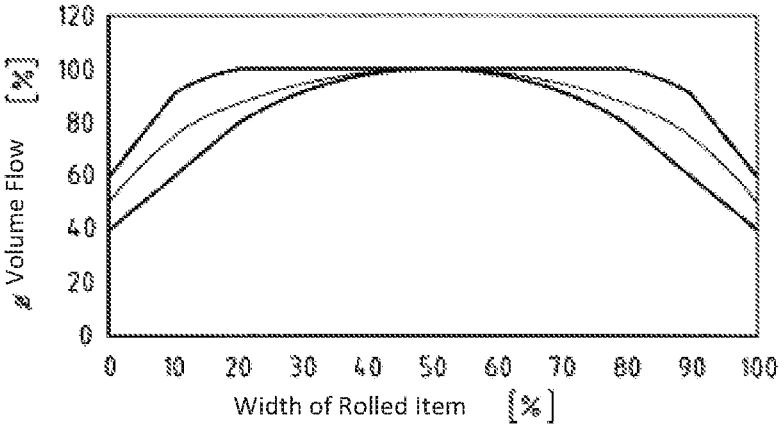
FIG. 5 shows variants of the distribution according to FIG. 4 by variation of the volume flow of the coolant in the peripheral regions of the metallic item.

FIG. 5 initially shows the same distribution function as in FIG. 4, see the middle function in FIG. 5. Furthermore, FIG. 5 shows a function that is more strongly or weakly curved in the peripheral regions than the middle function; this is implemented by a reduction of the quantities of water in the peripheral zones. Finally, a differently modified distribution function can be seen above the function from FIG. 4; this is implemented by a corresponding increase of the quantities of water in the peripheral zones. It is particularly advantageous if not all similar peripheral zones within a group are connected in parallel with respect to the coolant application here, i.e., the same volume flow or the same pressure for the coolant is applied to them, but rather if these adjustment parameters are adjustable by control valves provided individually for the individual application regions per cooling bar.

Overall, FIG. 5 shows the possibilities when using different application regions in the cooling bars of a group with simultaneous variation of the quantities of coolant or the pressure of the coolant in the individual application regions of a group.

The cooling device 100 according to the invention is typically connected downstream of the last rolling stand of a rolling mill. At least one first group G of cooling bars 110 is arranged in the cooling device to apply the coolant to the upper side of the metallic item and/or at least one second group is arranged to apply the coolant to the lower side of the metallic item.

The pressure or the volume flow of the coolant 300 in the individual applications I, II, and III of at least one cooling bar 110 within the group G can be adjusted in each case as a function of at least one of the following parameters: The width of the metallic item, the temperature distribution of the metallic item to be cooled over its width, or as a function of the chemical composition of the material or the material properties of the metallic item.

These mentioned parameters can be measured and/or calculated either at the input and/or at the output of the cooling device. If they are detected at the input of the cooling device, this is thus referred to as a public control; if the parameters are detected at the output of the cooling device, it can thus be a regulation.

While the design of the individual application regions I, II, and III shown by way of example in FIGS. 1 to 3 is permanently predetermined in each case in each cooling device according to the invention, the distribution of the pressure or the volume flow of the coolant 300 over the length of the cooling bar 100 or in the individual application regions I, II, and III can be changed as a function of the above-mentioned parameters during the passage of the metallic item 200 through the cooling device 100.

LIST OF REFERENCE SIGNS

100 cooling device
110-*n* cooling bars
110-1 first cooling bar
110-2 second cooling bar
120 control unit
130 valves
140 boundary line between two adjacent cooling bars of a cooling bar
150 application tubes or nozzles
200 metallic item, in particular rolled item
300 coolant
G group
T transport direction of the rolled item
X longitudinal direction
I left application region
II middle application region
III right application region
α angle

The invention claimed is:

1. A cooling device for cooling a metallic item, comprising:

at least one group of cooling bars having at least one first and one second cooling bar arranged in parallel for applying a coolant to the metallic item, wherein each cooling bar has at least one first and one second application region having application tubes or nozzles, which are arranged in succession along a longitudinal direction of the cooling bar; and a control unit having valves for individually adjusting a pressure and/or a volume flow of the coolant in each of the application regions;

wherein the first application region of the first cooling bar comprises a contour and/or an area different from a contour and/or an area on the first application region of the second cooling bar adjacent to the first cooling bar in each group.

2. The cooling device as claimed in claim 1, wherein a boundary line between the first and second application regions of the first cooling bar and a boundary line between the first and second application regions of the second cooling bar are inclined at different angles α in relation to a longitudinal axis of the respective cooling bar; and/or wherein the boundary line between the first and second application region of the first cooling bar and the boundary line between the first and second application region of the second cooling bar are positioned differently along the longitudinal axis of the cooling bars.

3. The cooling device as claimed in claim 2, wherein the following applies to the angle α: $30 \leq \alpha \leq +30°$.

4. The cooling device as claimed in claim 1, wherein each cooling bar also has, in addition to the first application region and the second application region, a third, right, application region, wherein the first application region is on a left side of the bar, and the second application region is between the first application region and third, right, application region; and wherein the first application region of the first cooling bar is designed differently in its contour and/or area than the first application region of the second cooling bar in the at least one group, and/or wherein the second application region of the first cooling bar is formed differently in its contour and/or area than the second application region of the second cooling bar in the at least one group, and/or wherein the third application region of the first cooling bar is formed differently in its contour and/or area than the right application region of the second cooling bar in the at least one group.

5. The cooling device as claimed in claim 4, wherein the first and third application regions are each triangular and the second application region is trapezoidal.

6. The cooling device as claimed in claim 4, wherein the first, second, and third application regions are each trapezoidal.

7. The cooling device as claimed in claim 4, wherein at least one of the cooling bars of each group has at least two parallel rows of application tubes or nozzles, wherein the boundary line extends between the application tubes or nozzles.

8. The cooling device as claimed claim 4, wherein the cooling bars of each group are each arranged immediately adjacent at least one other cooling bar and transversely to a transport direction of the cooling metal.

9. The cooling device as claimed in claim 8, wherein at least two cooling bars of each group have the same or a different number of application regions.

10. The cooling device as claimed in claim 9, wherein the same application regions in the first and the parallel second cooling bars of each group are connected to one and the same valve.

11. The cooling device of claim 1, wherein the first and second application regions in the first and the parallel second cooling bars of each group are connected to one and the same valve.

* * * * *